US007654580B2

(12) United States Patent
Alasia et al.

(10) Patent No.: US 7,654,580 B2
(45) **Date of Patent: *Feb. 2, 2010**

(54) SELF-AUTHENTICATING DOCUMENTS WITH PRINTED OR EMBOSSED HIDDEN IMAGES

(75) Inventors: Alfred V. Alasia, Lake Worth, FL (US); Alfred J. Alasia, Royal Palm Beach, FL (US); Thomas C. Alasia, Lake Worth, FL (US)

(73) Assignee: Graphic Security Systems Corporation, Lake Worth, FL (US)

( * ) Notice: Subject to any disclaimer, the term of this patent is extended or adjusted under 35 U.S.C. 154(b) by 277 days.

This patent is subject to a terminal disclaimer.

(21) Appl. No.: 11/506,678

(22) Filed: Aug. 18, 2006

(65) Prior Publication Data

US 2006/0290136 A1 Dec. 28, 2006

Related U.S. Application Data

(63) Continuation-in-part of application No. 11/108,444, filed on Apr. 18, 2005, now Pat. No. 7,341,200, which is a continuation of application No. 09/267,420, filed on Mar. 11, 1999, now Pat. No. 7,114,750, which is a continuation-in-part of application No. 09/005,736, filed on Jan. 12, 1998, now Pat. No. 6,859,534, which is a continuation-in-part of application No. 08/564,664, filed on Nov. 29, 1995, now Pat. No. 5,708,717.

(51) Int. Cl.
*B42D 15/00* (2006.01)
*B42D 15/10* (2006.01)

(52) U.S. Cl. ..... 283/74; 283/72; 283/901; 283/902

(58) Field of Classification Search ..... 283/72, 283/74, 75, 77, 901, 902; 399/366; 428/29, 428/195.1; 434/327, 331
See application file for complete search history.

(56) References Cited

U.S. PATENT DOCUMENTS

| | | | | |
|---|---|---|---|---|
| 3,875,026 A * | 4/1975 | Widmer | ..... | 205/50 |
| 4,972,476 A | 11/1990 | Nathans | | |
| 4,999,234 A * | 3/1991 | Cowan | ..... | 428/156 |

(Continued)

FOREIGN PATENT DOCUMENTS

| | | |
|---|---|---|
| IL | 155659 | 4/2003 |

(Continued)

*Primary Examiner*—Dana Ross
*Assistant Examiner*—Pradeep C Battula
(74) *Attorney, Agent, or Firm*—Hunton & Williams LLP

(57) ABSTRACT

A self-authenticating article comprising a substrate having an image receiving surface and a lenticular lens is provided. The lenticular lens has a predetermined lens frequency and is configured for optically decoding encoded indicia viewed therethrough. The lens is attached to the substrate so that the lens can be selectively positioned to overlie the image receiving surface to decode encoded indicia printed thereon. The self-authenticating article further comprises an encoded image on the image receiving surface, the encoded image comprising at least one of the set consisting of printed indicia and indicia formed as variations in surface geometry of the image receiving surface. The surface geometry variations may comprise raised and non-raised areas surface areas that combine to define at least a portion of the indicia.

12 Claims, 5 Drawing Sheets

U.S. PATENT DOCUMENTS

| | | | | | |
|---|---|---|---|---|---|
| 5,128,779 | A | * | 7/1992 | Mallik | 359/2 |
| 5,249,546 | A | * | 10/1993 | Pennelle | 116/234 |
| 5,608,203 | A | | 3/1997 | Finkelstein et al. | |
| 5,708,717 | A | * | 1/1998 | Alasia | 380/51 |
| 5,722,693 | A | * | 3/1998 | Wicker | 283/67 |
| 6,062,604 | A | * | 5/2000 | Taylor et al. | 283/72 |
| 6,073,854 | A | | 6/2000 | Bravenec et al. | |
| 6,104,812 | A | * | 8/2000 | Koltai et al. | 380/51 |
| 6,176,430 | B1 | | 1/2001 | Finkelstein et al. | |
| 6,390,372 | B1 | | 5/2002 | Waters | |
| 6,523,826 | B1 | * | 2/2003 | Matos | 273/155 |
| 6,769,618 | B1 | | 8/2004 | Finkelstein | |
| 6,817,532 | B2 | | 11/2004 | Finkelstein | |
| 7,114,750 | B1 | * | 10/2006 | Alasia et al. | 283/72 |
| 7,226,087 | B2 | * | 6/2007 | Alasia et al. | 283/74 |
| 7,315,407 | B2 | * | 1/2008 | Menz et al. | 359/2 |
| 2002/0163678 | A1 | * | 11/2002 | Haines et al. | 359/2 |
| 2003/0201331 | A1 | | 10/2003 | Finkelstein | |
| 2005/0057036 | A1 | | 3/2005 | Ahlers et al. | |

FOREIGN PATENT DOCUMENTS

| | | | |
|---|---|---|---|
| IL | 161904 | | 5/2004 |
| WO | WO 99/01291 | A2 | 1/1999 |
| WO | WO 2004/096570 | A2 | 11/2004 |
| WO | WO 2005/109325 | A2 | 11/2005 |

* cited by examiner

SELF-AUTHENTICATING DOCUMENTS WITH PRINTED OR EMBOSSED HIDDEN IMAGES

CROSS-REFERENCE TO RELATED APPLICATIONS

This application is a continuation-in-part of U.S. application Ser. No. 11/108,444 filed Apr. 18, 2005, now U.S. Pat. No. 7,341,200 which is a continuation of U.S. application Ser. No. 09/267,420, filed Mar. 11, 1999 now U.S. Pat. No. 7,114, 750, which is a continuation-in-part of U.S. application Ser. No. 09/005,736, filed Jan. 12, 1998, now U.S. Pat. No. 6,859, 534, which is a continuation-in-part of U.S. application Ser. No. 08/564,664, filed Nov. 29, 1995, now U.S. Pat. No. 5,708, 717, all of which are incorporated herein by reference.

FIELD OF THE INVENTION

This invention relates to security documents and in particularly to documents that use encoded hidden images for self-authentication.

BACKGROUND INFORMATION

To prevent unauthorized duplication or alteration of documents, frequently there is special indicia or a background pattern that may be provided for sheet materials such as tickets, checks, currency, and the like. The indicia or background pattern is imposed upon the sheet material usually by some type of printing process such as offset printing, lithography, letterpress or other like mechanical systems, by a variety of photographic methods, by xeroprinting, and a host of other methods. The pattern or indicia may be produced with ordinary inks, from special inks which may be magnetic, fluorescent, or the like, from powders which may be baked on, from light sensitive materials such as silver salts or azo dyes, and the like. Most of these patterns placed on sheet materials depend upon complexity and resolution to avoid ready duplication. Consequently, they add an increment of cost to the sheet material without being fully effective in many instances in providing the desired protection from unauthorized duplication or alteration.

Various methods of counterfeit-deterrent strategies have been suggested including Moire-inducing line structures, variable-sized dot patterns, latent images, see-throughs, barcodes, and diffraction based holograms. However, none of these methods employs a true scrambled image or the added security benefits deriving therefrom.

The inventor of the technology disclosed in this patent previously invented a system for coding and decoding indicia placed on printed matter by producing a parallax panoramagram image. These principles and embodiments of U.S. Pat. No. 3,937,565, issued Feb. 10, 1976 and are hereby incorporated by reference. The indicia were preferably produced photographically using a lenticular plastic screen (i.e. a lenticular screen) with a known spatial lens density (e.g. 69 lines per inch). A specialized auto-stereoscopic camera might be used to produce the parallax image such as the one described in this inventor's U.S. Pat. No. 3,524,395, issued Aug. 18, 1970, and U.S. Pat. No. 3,769,890, issued Nov. 6, 1973.

Photographic, or analog, production of coded indicia images has the drawback of requiring a specialized camera. Also, the analog images are limited in their versatility in that an area of scrambled indicia is generally noticeable when surrounded by non-scrambled images. Also, it is difficult to combine several latent images, with potentially different scrambling parameters, due to the inability to effectively re-expose film segments in generating the scrambled, photographic image. Furthermore, it is difficult to produce secure documents, such as currency, traveler's checks, stock and bond certificates, bank notes, food stamps and the like which are formed from a durable material resistant to tearing, staining, fraying, and deterioration from day-to-day contact.

Accordingly, a method and apparatus are needed whereby a photographic process or physical process and its results are essentially simulated digitally via a computer system and related software. Additionally, a system is needed whereby scrambled latent images can be integrated into a source image, or individual color components thereof, so that the source image is visible to the unaided eye and the latent image is visible only upon decoding. Also needed is the ability to incorporate multiple latent images, representing different "phases", into the source image for added security. Furthermore, what is needed is the ability to apply this technology to a durable substrate, such as a synthetic paper, and to incorporate an appropriate verification lens integral within the document's structure.

SUMMARY OF THE INVENTION

An aspect of the invention provides a self-authenticating article comprising a substrate having an image receiving surface and a lenticular lens. The lenticular lens has a predetermined lens frequency and is configured for optically decoding encoded indicia viewed therethrough. The lens is attached to the substrate so that the lens can be selectively positioned to overlie the image receiving surface to decode encoded indicia printed thereon. The self-authenticating article further comprises an encoded image on the image receiving surface, the encoded image comprising at least one of the set consisting of printed indicia and indicia formed as variations in surface geometry of the image receiving surface. The surface geometry variations may comprise raised and non-raised areas surface areas that combine to define at least a portion of the indicia.

Another aspect of the invention provides a method of producing a self-authenticating article. The method comprises providing a document comprising a substrate having an image receiving surface and a decoder lens having a lens frequency. The decoder lens is configured for optically decoding corresponding encoded indicia viewed therethrough. The document is configured so that the decoder lens may be selectively positioned to overlie the image receiving surface to decode encoded indicia formed thereon. The method further comprises digitally encoding a source image to produce a rasterized encoded image having a raster frequency corresponding to the lens frequency and applying the encoded image to the image receiving surface of the substrate. The image receiving surface may have a surface geometry that is initially substantially flat and the action of applying the encoded image may include reforming the surface geometry of the image receiving surface to include a plurality of alternating topographical features that collectively correspond to the encoded image. The action of reforming the surface geometry may include at least one of the set consisting of embossing the substrate, debossing the substrate, and removing material from the substrate.

Advantages of the invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
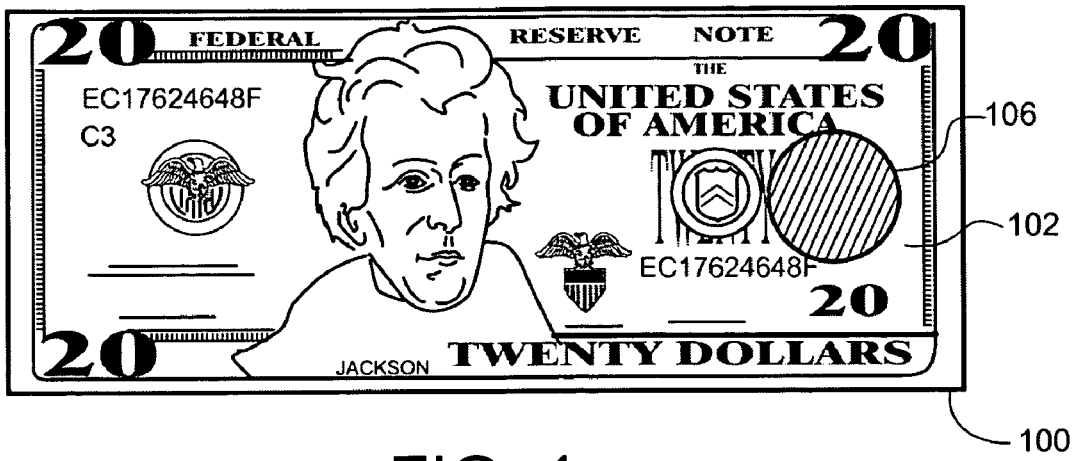
FIG. 1 is a front pictorial view of a self-authenticating currency document.

Although the invention will be described in terms a specific embodiment with certain alternatives, it will be readily apparent to those skilled in this art that various modifications, rearrangements and substitutions can be made without departing from the spirit of the invention. The scope of the invention is defined by the claims appended hereto.

The present invention provides a durable and self-verifying secure document system and methods for its production. The secure document system is potentially useful for a wide variety of documents including, but not limited to, lottery tickets, especially probability game lottery tickets, currency, traveler's checks, passports, stock and bond certificates, bank notes, driver's licenses, wills, coupons, rebates, contracts, food stamps, magnetic stripes, test answer forms, invoices, tickets, inventory forms, tags, labels and original artwork.

The self-authenticating documents of the invention are constructed so that a first portion of the document has an encoded image and a second portion of the document has a decoder that can be used to decode the encoded image. In typical embodiments, the encoded image comprises a source or background image in which a hidden image is embedded, the hidden image being viewable only through the use of the decoder portion of the deocument.

Encoded images of particular significance to the present invention are those that are configured to be optically decoded using a lens-based decoding device. Such images take advantage of the ability of certain types of lenses (e.g., a lenticular lens) to sample image content based on the their optical characteristics. For example, a lenticular lens can be used to sample and magnify image content based on the lenticule frequency of the lens. The images used are typically encoded by one of several methods that involve establishing a regularized periodic pattern having a frequency corresponding to that of the lenticular lens to be used as a decoder, then introducing distortions of the pattern that correspond to the content of the image being encoded. These distortions may be made so small as to render the image difficult to discern from the regularized pattern by the naked eye. Encoded images of this type can be produced in an analog fashion using specialized photographic equipment as disclosed in U.S. Pat. No. 3,937,565 or digitally as is disclosed in U.S. Pat. No. 5,708,717 ('717 Patent), both of which are incorporated herein by reference in their entirety. Encoded images may be further encoded to produce a holographic image as described in U.S. Pat. No. 6,859,534 ('534 Patent), which is also incorporated herein by reference.

Encoded images may be applied to a substrate through the application of ink or other print media or through the application of systematic changes to the surface contour (topography) of the substrate, such as by embossing or debossing. In either approach, the encoded image may be formed with characteristics that correspond to the optical characteristics of an optical decoder, such as the lenticular lens discussed above. For example, an encoded image may comprise a source image applied to a document surface using regular periodic raster elements. Prior to application of the source image, however, a hidden image may be embedded into the source image by introducing small deviations in the regular raster elements in locations corresponding to the content of the hidden image. A lenticular lens decoder having a lens frequency corresponding to a frequency of the raster elements can be used to decode and view the hidden image.

Encoded images for use in self-authenticating documents according to the invention may be produced in any suitable fashion. In particular embodiments, digital encoded images may be produced using the methods described in the '717 Patent and the '534 Patent. These methods may include a process of rasterizing, or dividing up into lines (or other raster elements), a source or visible image according to the frequency (or density) of a lenticular decoder lens. The number of lines is also a function of the scrambling factor, or zoom factor, as applied to a latent or secondary image. After the latent image is processed and scrambled, a set of scrambled or hidden lines exists which can then be combined into the rasterized lines of the visible image. The visible image is thus reformed, or re-rasterized, according to the pattern of the hidden latent image lines. Where the visible image is darker, the scrambled or hidden lines are made proportionately thicker in re-forming the rasterized lines of the visible image; similarly, where the visible image is lighter, the scrambled lines are made proportionately thinner. As a result, a new visible image is created, but with the encoded, latent, SI pattern being visible "underneath" when viewed through a transparent decoder lens.

It will be understood by those of ordinary skill in the art that the above discussion is applicable to images that are made up of discrete raster elements rather than linear rasters.

The resulting encoded image may be applied to a surface through the application of a print medium at locations corresponding to the raster elements. Alternatively, the surface of a substrate may be embossed or debossed to establish protrusions or depressions corresponding to the raster elements.

The self-authenticating documents of the invention may be produced from a variety of suitable materials including both paper and paper substitutes. Comparison of paper in general use prepared from pulp with recently developed synthetic resin film shows that pulp paper generally has lower tensile strength, dimensional stability and resistance to moisture, water corrosion and folding, than the latter. Synthetic resin films having high writability and printability have been marketed which eliminate the above-mentioned drawbacks of pulp paper. These synthetic resin films are often treated to enhance printability. These treatments include physical treatment processes such as those which sandblast, emboss and mat the surface of synthetic resin film, apply corona discharges to said surface or subject said film to high temperature treatment; ozone treatment processes, chemical treatment processes such as those which treat the surface of synthetic resin film with chemicals, for example, chlorine, peroxides, and mixed solutions of potassium chromate and concentrated sulfuric acid; and processes which coat said surface with high polymer compounds having a polar group such as polyvinyl alcohol, and carry out the graft polymerization of monomers having a polar group.

The instant invention is particularly durable when produced on one of the modern plastic paper substitutes. In one embodiment, a synthetic printing sheet sold under the trademark TESLIN by PPG Industries, Inc., may be utilized. The TESLIN material has the qualities of paper and is tough enough to survive very rough usage, such as that to which circulating currency is exposed. The base material is in the polyolefin family and can be adapted to a wide range of printing and fabricating techniques. It accepts a broad variety of inks and can be printed with offset, inkjet, screen, laser, and thermal transfer processes.

Another such material from which the secure documents of the instant invention could be manufactured is KIMDURA a synthetic paper, made by Kimberly-Clark Corporation, which is one of a variety of latex saturated durable papers produced by that corporation. These materials exhibit benefits in several critical areas including cost reduction. KIMDURA is a polypropylene film which is not only completely recyclable, but is so durable that it can be used for a long period of time. Other similar materials are sold under the trademarks PREVAIL, BUCKSIN, TEXOPRINT, TEXOPRINT II and DURAWEB, all of which are manufactured by the Kimberly-Clark Corporation. These materials represent durable paper substitutes which have been designed for unique applications involving toughness and aesthetic excellence. They retain the look, touch and feel of long lasting durable papers.

Still other materials which could be utilized include those sold under the trademarks ASCOT and TYVEK, both of which are products of DuPont Corp; the material sold under the trademark ASCOT is made from 100% polyolefin filaments randomly dispersed and bonded to provide paper-like properties. To this base sheet, a specially formulated coating is applied to assure high fidelity printing and to protect the filaments from the degrading effect of prolonged exposure to light. ASCOT requires the use of specially formulated ink containing no more than 3% volatile material to prevent swelling and distortion of the paper substitute material. High tack and viscosity inks are recommended to obtain even ink lay in solids and even tone in screen areas. ASCOT'S unusual features of strength, tear resistance, fold resistance, durability, water and light resistance and no grain direction, combined with its low weight to bulk ratio, make it well-suited for secure document applications.

Cellulose tear-resistant materials include the MASTER-FLEX brand of latex impregnated enamels providing high quality sheets are manufactured by Appleton. The material is a latex impregnated enamel providing a high quality sheet of paper substitute material which is formed on a fourdrinier machine with a unique makeup that enables the sheet to accept saturation process. After saturation, the web of Master-Flex material passes through squeeze rolls to remove excess saturants. Then, it is cured and dried. Double coaters apply the highly specialized coating, composed of clays, brighteners and adhesives, for producing a pinhole-free sheet. Supercalendered to a smooth, level surface with medium gloss finish, the MASTER-FLEX material is designed primarily for offset printing, offering good ink holdout. Quick-set inks are recommended for both offset and letterpress production. The surface accepts varnishes, lacquers and adhesives and converting operations, such as sewing, diecutting and perforating. A sheet of this material can be folded and refolded without cracking or flaking.

Other plastic paper substitutes or sturdy papers, paper boards, reinforced papers and reinforced paper substitutes, along with laminate composites including combinations of paper and non-paper materials are contemplated as suitable substrates for the secure documents disclosed herein. For convenience of expression all of these similar substrates will be identified as "plastic paper substitutes" in this specification and in the claims.

Figure 2:
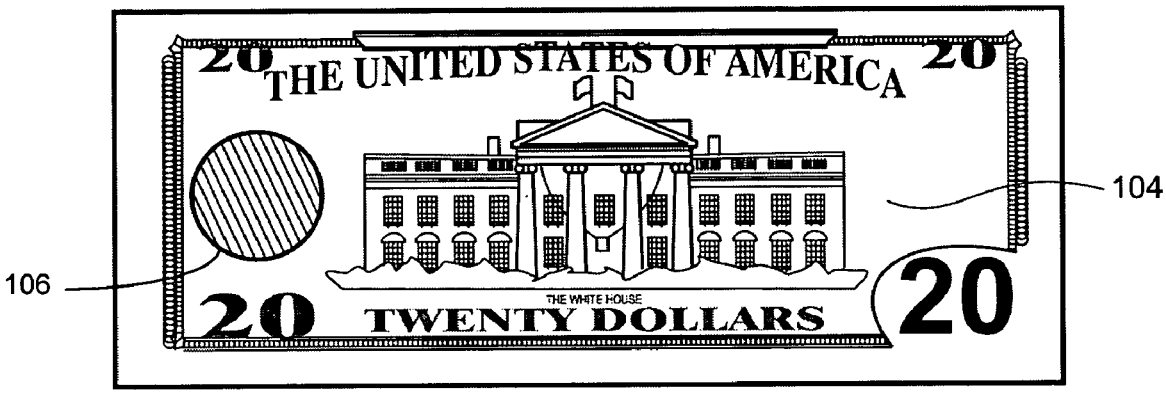
FIG. 2 is a rear pictorial view of the self-authenticating currency document of FIG. 1.
Figure 3:
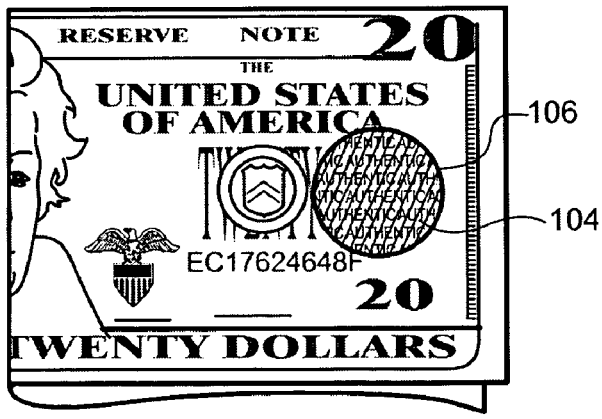
FIG. 3 is a pictorial view of the self-authenticating currency document of FIG. 1 in a folded configuration.

Referring to FIGS. 1-3, an example of a self-verifying secure document 100 is illustrated. The self-verifying document 100 is a currency document having a front surface (shown in FIG. 1) and a rear surface (shown in FIG. 2). The depicted currency document 100 comprises a substrate 102 having various indicia associated therewith including an encoded image 104 comprising hidden indicia applied to the rear surface. The substrate 102 may be formed from any suitable paper or paper substitute material and is particularly durable when produced on one of the modern plastic paper substitutes. The encoded image 104 may be applied to the substrate 102 by applying a visible or transparent print medium or by embossing or debossing the surface of the substrate 102. The encoded image 104 may comprise visible and non-visible indicia and may be applied in conjunction with non-encoded visible indicia.

The document 100 includes an integral decoder lens area 106 which is formed with optical characteristics corresponding to the characteristics of the encoded image so that when the decoder lens area 104 is positioned over the encoded image 104 as shown in FIG. 3, the hidden indicia may be viewed.

The decoder lens area 104 may comprise a lenticular leans, which can be inlaid, preformed, or produced by an intaglio engraving process. The decoder lens area 104 may be integrally formed with the document 100 or may be permanently attached to or laminated with the substrate 102. The decoder lens area 104 is positioned and the self-authenticating document 100 is formed so that the decoder lens area can be easily positioned over the encoded image 104 in the proper orientation for easy self-verification of authenticity. A self authenticating document 100 may include multiple encoded images or may have a single encoded image having multiple hidden images embedded therein. In either case, the hidden indicia in the latent images may be encoded with different encoding characteristics requiring corresponding decoder characteristics and/or viewing orientations.

The substrate 102 may be formed from a plastic paper substitute selected from the group consisting of synthetic resin films having a high degree of writability and printability, laminate composite structures including combinations of paper and non-paper materials, latex saturated durable papers, coated polyolefin substrates formed from randomly dispersed and bonded polyolefin filaments, reinforced papers, and combinations thereof. Other suitable substrate materials may also be used.

Figure 4:
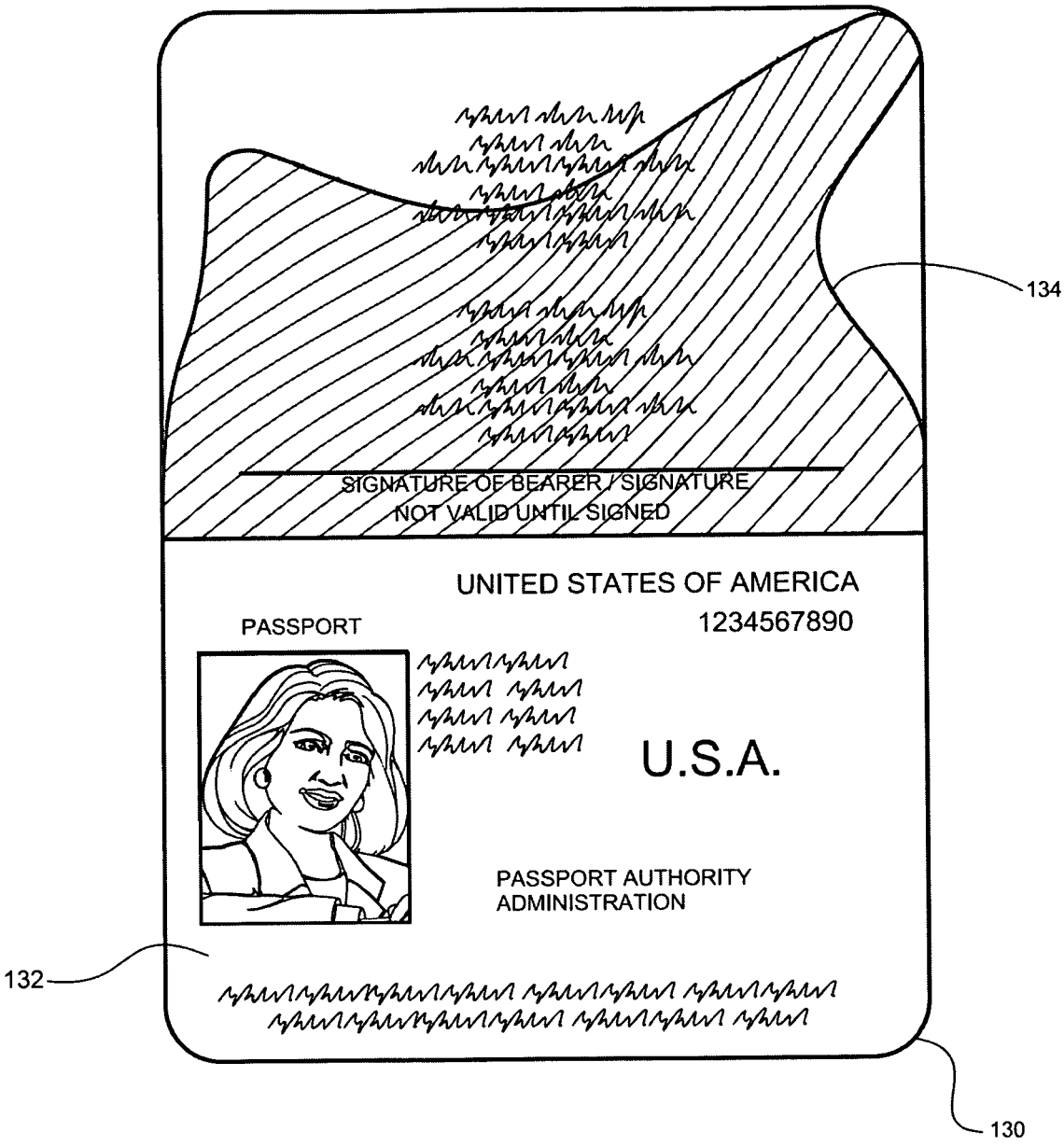
FIG. 4 is a pictorial view of a self-authenticating document according to an embodiment of the invention.
Figure 5:
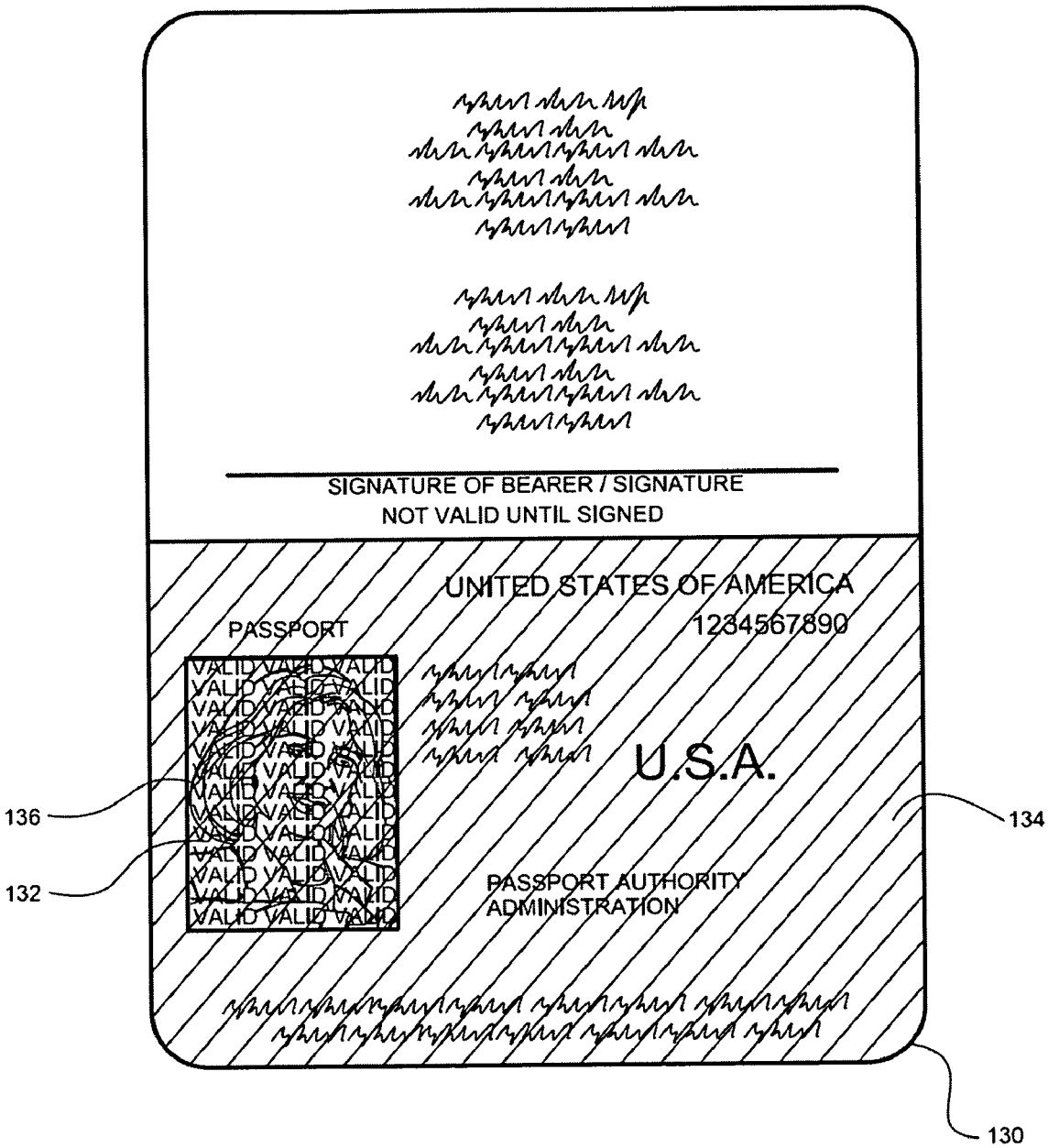
FIG. 5 is a pictorial view of the self-authenticating document of FIG. 4 in an authentication configuration.
Figure 6:
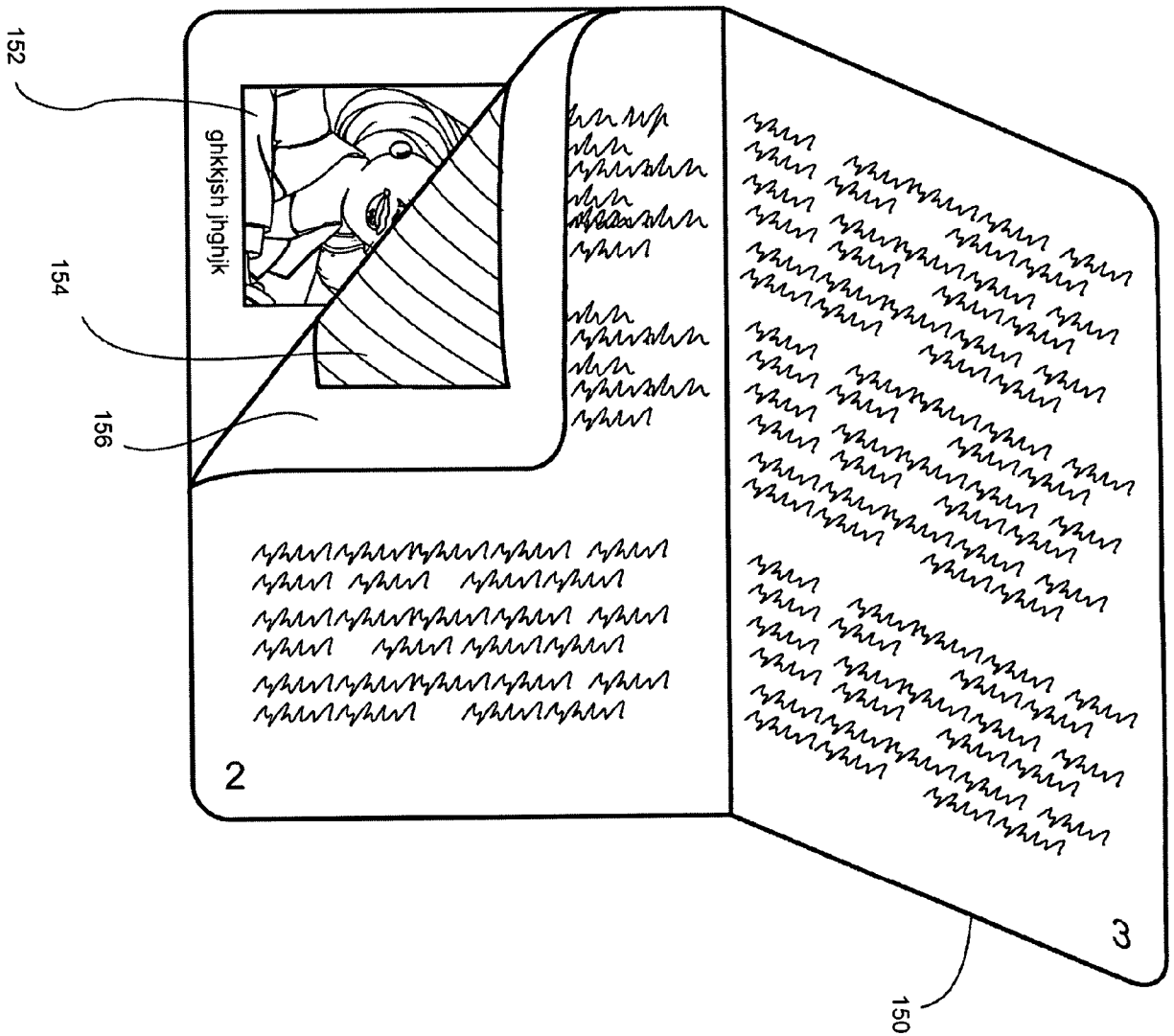
FIG. 6 is a pictorial view of a self-authenticating document according to an embodiment of the invention.
Figure 7:
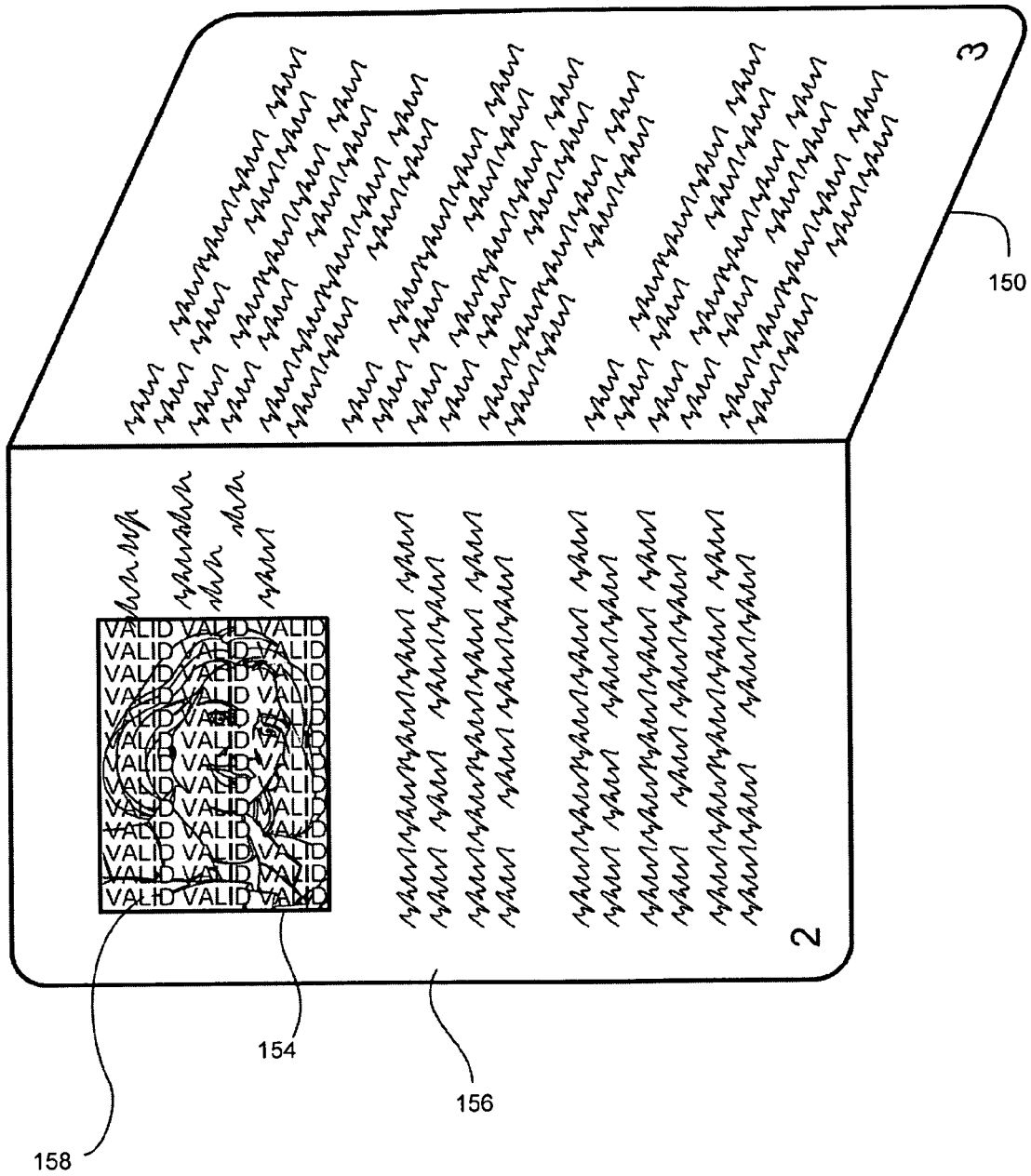
FIG. 7 is a pictorial view of the self-authenticating document of FIG. 6 in an authentication configuration.

FIG. 4 is a pictorial view of a self-authenticating document 130 according to another embodiment of the invention. The document 130 may be an identification document such as a passport that includes an encoded image 132 having hidden indicia embedded therein. The document 130 may be formed in a book-like configuration with the encoded image formed on one of the pages. The document 130 comprises a decoder lens 134, which may be formed as a page of the document 130 that is adjacent the page having the encoded image 132. Thus, the decoder lens 134 is sized to follow the shape of the closed document 130. The lens 134 may be formed as a pliable sheet from a suitable material and may be attached to the passport in a manner to that used for the remaining pages. As shown in FIG. 5, placement of the decoder lens 134 over the encoded image reveals the hidden indicia "VALID."

FIG. 5 depicts a pictorial view of a self-authenticating document 150 according to another embodiment of the invention. The document 150 may be an identification document such as a passport that includes an encoded image 152 having hidden indicia embedded therein. The document 150 may be configured in a similar fashion to the document 130 of FIGS. 4 and 5. In this embodiment, however, a decoder lens 154 is attached to or integrally formed with a regular page 156 of the document 150 so that the decoder lens 154 is part of the page 156. The page 156 is positioned adjacent the document page having the encoded image 152. As shown in FIG. 5, when the page 156 is placed over the encoded image 152, the hidden indicia "VALID" is revealed.

As noted above, encoded images may be applied to a substrate through the application of a suitable print medium. If a print medium is used the print medium may comprise ordinary inks, special inks which may be magnetic, fluorescent, or the like, powders that may be baked on to the substrate, light sensitive materials such as silver salts or azo dyes, and the like. The print medium may also comprise inks and toners having properties that are not ordinarily viewable in the visible spectrum. These may include UV and IR inks such as those described in U.S. Pat. No. 6,985,607, which is incorporated herein by reference in its entirety. The print medium may alternatively comprise a light transmittent medium such as those disclosed in U.S. Pat. No. 6,980,654, which is also incorporated herein by reference in its entirety.

The print medium may be applied by any printing process that provides sufficient resolution to produce an encoded image with the desired characteristics. Suitable processes include but are not limited to offset printing, lithography, letterpress or other like mechanical systems, a variety of photographic methods, xeroprinting, and others.

As an alternative to application of a print medium, encoded images may be applied to a substrate by reforming the surface geometry of the substrate in a manner that corresponds to the encoded image elements. This may be accomplished, for example by producing raised areas in the surface that correspond to encoded image elements (e.g., by embossing) or by producing depressed areas that correspond to encoded image elements (e.g., by debossing or by material removal techniques). Such surface geometry variations may be made independently of visible print media indicia.

Embossing and debossing of encoded images may be accomplished in any manner known in the art, but is typically accomplished through the use of mechanical presses. In typical embodiments, the encoded image is used to form a die which, in turn can be used to press the encoded image into a surface of the substrate. If a raised encoded image is desired, the die is formed with recesses corresponding to the elements of the encoded image. If a depressed encoded image is desired, the die is formed with raised areas corresponding to the elements of the encoded image.

In an alternative approach to mechanical embossing or debossing, substrate surface topography may be altered by various means of material removal. In this approach, material is removed from the substrate surface in areas corresponding to the encoded image elements. Substrate material may be removed in any manner providing sufficient resolution including through the use of mechanical or chemical etching.

A particularly suitable manner of applying encoded images through material removal is through the use of lasers. Lasers provide a highly precise and controllable mechanism that allows the production of encoded images with very fine detail. It will be understood that a laser may be used to remove material corresponding to the encoded image elements themselves to produce a depressed encoded image. Alternatively, a laser may be used to remove material that does not correspond to the encoded image, thus producing a raised encoded image.

Self authenticating articles having encoded images applied thereto and one or more decoder lenses incorporated therein are especially suited for currency, stock certificates, bond certificates, special event tickets, tax stamps, official certificates, passports, bank and travelers checks, anti-counterfeiting labels, birth certificates, land deed titles, visas, food stamps, lottery tickets, driver's licenses, holograms, insurance documents, wills, coupons, rebates, contracts, test answer forms, invoices, inventory forms, and original artwork in juxtaposed relation to said hidden indicia thereby providing instant verification of the authenticity of said article.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What is claimed is:

1. A method of producing a self-authenticating article comprising:

providing a document comprising a substrate having an image receiving surface and a decoder lens having a lens frequency and being configured for optically decoding corresponding encoded indicia viewed therethrough, the document being configured so that the decoder lens may be selectively positioned to overlie the image receiving surface to decode encoded indicia formed thereon;

digitally encoding a source image to produce a rasterized encoded image having a raster frequency corresponding to the lens frequency; and applying the encoded image to the image receiving surface of the substrate, wherein the image receiving surface has a surface geometry that is initially substantially flat and the action of applying the encoded image includes reforming the surface geometry of the image receiving surface to include a plurality of alternating topographical features that collectively correspond to the encoded image.

2. The method of claim 1 wherein the document comprises a plurality of pages, a first page comprising the substrate and a second page comprising the decoder lens.

3. The method of claim 1 wherein the substrate is formed from a plastic paper substitute.

4. The method of claim 1 wherein the action of applying the encoded image includes applying a print medium to the image receiving surface.

5. The method of claim 1 wherein the action of reforming the surface geometry includes at least one of the set consisting of embossing the substrate, debossing the substrate, and removing material from the substrate.

6. The method of claim 1 wherein the decoder lens is a lenticular lens.

7. The method of claim 1 wherein the action of digitally encoding a source image includes:

providing a secondary image for use as a latent image to be embedded into the source image;

rasterizing the source image at the raster frequency to form a plurality of source image raster elements;

mapping the secondary image to the source image; and shifting the source image raster elements at locations corresponding to content of the secondary image.

8. A self-authenticating article comprising:

a substrate having an image receiving surface;

a lenticular lens having a predetermined lens frequency, the lenticular lens being configured for optically decoding encoded indicia viewed therethrough and being attached to the substrate so that the lens can be selectively positioned to overlie the image receiving surface to decode encoded indicia applied thereto; and an encoded image on the image receiving surface, the encoded image comprising encoded indicia formed as variations in surface geometry of the image receiving surface.

9. The self-authenticating article of claim 8 wherein the surface geometry variations comprise depressed and non-depressed surface areas that combine to define at least a portion of the indicia.

10. The self-authenticating article of claim 8 wherein the surface geometry variations comprise raised and non-raised areas surface areas that combine to define at least a portion of the indicia.

11. The self-authenticating article of claim 8 wherein the self-authenticating article comprises a plurality of pages, a first page comprising the substrate and a second page comprising the lenticular lens.

12. The self-authenticating article of claim 8 wherein the substrate is formed from a plastic paper substitute.

* * * * *

UNITED STATES PATENT AND TRADEMARK OFFICE

CERTIFICATE OF CORRECTION

PATENT NO. : 7,654,580 B2
APPLICATION NO. : 11/506678
DATED : February 2, 2010
INVENTOR(S) : Alasia et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 445 days.

Signed and Sealed this

Twenty-third Day of November, 2010

David J. Kappos

David J. Kappos
*Director of the United States Patent and Trademark Office*